US006965741B2

(12) United States Patent
Senda

(10) Patent No.: US 6,965,741 B2
(45) Date of Patent: Nov. 15, 2005

(54) THERMAL FIXING DEVICE WITH HEATER OPERATION DIAGNOSING FUNCTION

(75) Inventor: Seiichi Senda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/395,111

(22) Filed: Mar. 25, 2003

(65) Prior Publication Data

US 2003/0185583 A1 Oct. 2, 2003

(30) Foreign Application Priority Data

Mar. 27, 2002 (JP) ..... 2002-088728

(51) Int. Cl.[7] ..... G03G 15/20
(52) U.S. Cl. ..... 399/33; 399/334
(58) Field of Search ..... 399/33, 69, 70, 399/330, 334; 219/216, 469, 470

(56) References Cited

U.S. PATENT DOCUMENTS

| | | | | |
|---|---|---|---|---|
| 4,415,800 A * | 11/1983 | Dodge et al. | 219/497 |
| 4,585,325 A * | 4/1986 | Euler | 399/69 |
| 4,897,696 A * | 1/1990 | Matsumoto | 399/33 |
| 6,320,168 B1 * | 11/2001 | Kimata et al. | 219/619 |
| 6,438,335 B1 * | 8/2002 | Kinouchi et al. | 399/67 |
| 6,697,580 B2 * | 2/2004 | Nakayama | 399/33 |

FOREIGN PATENT DOCUMENTS

| | | | | |
|---|---|---|---|---|
| JP | A 53-076288 | | 7/1978 | |
| JP | A 53-76288 | | 7/1978 | |
| JP | 63212977 A | * | 9/1988 | G03G 15/20 |
| JP | A 64-084273 | | 3/1989 | |
| JP | A 05-6126 | | 1/1993 | |
| JP | 05035147 A | * | 2/1993 | G03G 15/20 |
| JP | A 7-64437 | | 3/1995 | |
| JP | A 11-167307 | | 6/1999 | |
| JP | 11174896 A | * | 7/1999 | G03G 15/20 |
| JP | A 2000-275998 | | 10/2000 | |
| JP | B2 3121975 | | 10/2000 | |
| JP | A 2001-147615 | | 5/2001 | |
| JP | A 2001-272876 | | 10/2001 | |
| JP | 2001305904 A | * | 11/2001 | G03G 15/20 |

* cited by examiner

*Primary Examiner*—Robert Beatty
(74) *Attorney, Agent, or Firm*—Oliff & Berridge, PLC

(57) ABSTRACT

A thermal fixing device is equipped with a plurality of heaters for heating a fixing member at different axial positions thereof for proper temperature control. When the difference between the center temperature $T_A$ and the end temperature $T_B$ exceeds a proper temperature difference range (15° C.), of the center temperature $T_A$ and the end temperature $T_B$, the one nearer to the average temperature $T_m$ of the fixing upper limit temperature $T_h$ and the fixing lower limit temperature $T_1$. is selected. The control value for the farther halogen lamp is changed so as to approach the selected temperature. When the temperature difference is 10° C. or less, the control value is further changed. With this process, it is possible to set both the temperatures and the portion near the center of the thermal roller to temperatures within the proper temperature range.

18 Claims, 9 Drawing Sheets

THERMAL FIXING DEVICE WITH HEATER OPERATION DIAGNOSING FUNCTION

BACKGROUND OF THE INVENTION

1. Field of the Invention

The present invention relates to a thermal fixing device and an image forming apparatus equipped with the thermal fixing device.

2. Description of the Related Art

In order to thermally fix a toner image transferred to a sheet, an image forming apparatus, such as a laser printer, is usually equipped with a thermal fixing device having a thermal roller and a pressure roller. The toner image transferred to the sheet is thermally fixed while the sheet passes between the thermal roller and the pressure roller. The thermal fixing device also includes a temperature controller that controls temperature along the entire axial length of the thermal roller to within a fixed temperature range.

The following problem arises when the same thermal fixing device is used to thermally fix toner images on two differently sized sheets, that is, both a small size sheet (e.g., A6) and a large size sheet (e.g., A4). Assumed that first the thermal fixing device is used to fix toner images on a series of small size sheets. When the sheets contact the thermal roller, the sheets draw heat away from the thermal roller surface that contacts the small size sheets To insure that temperature of the thermal roller does not drop below the fixed temperature range, the temperature controller controls to heat up the thermal roller at portions in contact with the small size sheet to within the fixed temperature range. Because the temperature controller controls heat across the entire length of the thermal roller, the temperature at non-contacting portions of the thermal roller, that is, the temperature at the two axial end portions of the thermal roller, will increase to higher than the fixed temperature range.

Next, assume that the thermal fixing device is used to fix toner images on a series of large size sheets. Because the end portions of the thermal roller are excessively hot when they contact the large size sheet, the toner is excessively melted by the hot end portions. The excessively melted toner can stick to the surface of the thermal roller and be transferred onto sheets that are subsequently printed. This is referred to as hot offset.

SUMMARY OF THE INVENTION

FIG. 1 shows a conceivable thermal fixing device capable of thermal fixing images on both a small size sheet 3*a* (e.g., A6) and a large size sheet 3*b* (e.g., A4), without the problem of hot offset.

The thermal fixing device has a thermal roller 26 formed as a cylinder and with a length that corresponds to the width of the maximum size sheet so that thermal fixing can be effected on a sheet of the maximum size acceptable for the image forming apparatus. The thermal roller contains a heater extending across the entire axial length of the heater roller.

The heater includes a center halogen lamp A and an end halogen lamp B. The center halogen lamp A heats a central portion of the thermal roller 26 that corresponds to the width of the small size sheet 3*a*. The end halogen lamp B heats the lengthwise ends of the thermal roller 26, which correspond to the edges of the large sized sheet 3*b*. With this configuration, the heater can fix images on sheets of any size. A temperature sensor 40 is disposed at the border between the center and end halogen lamps A, B for detecting temperature at the surface of the thermal roller 26. Also, a controller 100*c* is provided for controlling drive of the lamps A, B based on the temperature sensor 40.

However, even this conceivable configuration has limits to accuracy of temperature control of the thermal roller 26. As shown in FIG. 1, the temperature sensor 40 for temperature control feedback detects the temperature near the border region between the center halogen lamp A and the end halogen lamp B. This border region is heated by both the halogen lamps A and B.

If, for example, the center halogen lamp A produces insufficient heat and the end halogen lamp B produces excessive heat, then the temperature sensor may indicate that the temperature is appropriate.

If one of the halogen lamps A, B breaks down, not only is it impossible to performed temperature control properly, but temperature detection is also difficult. If, for example, one of the halogen lamps A and B has a problem that lowers the temperature of the thermal roller 26, and this lower temperature is detected by the temperature sensor 40, then the administrator needs to be informed that one of the two halogen lamps A and B has a problem. Then, the administrator will need to check to see which of the halogen lamps A and B has the problem.

The problem lamp A or B can conceivably be determined automatically using the following method. First, power supply to one of the halogen lamps, lamp A for example, is stopped and the portion of the thermal roller 26 that was heated by the halogen lamp A is waited to cool. Once enough time has elapsed to be sure that that halogen lamp A no longer influences the temperature of the thermal roller 26, then the thermal roller 26 is heated using only the halogen lamp B. Whether the lamp B is operating properly can be judged based on the temperature measured by the sensor 40 at that time. If there is no problem with the lamp B, then it can be judged that the problem is with the halogen lamp A. In this conceivable method, however, it is necessary to wait very long for the thermal roller 26 to be cooled.

Such a problem is involved not only in an image forming apparatus using a thermal fixing device, but also in a device heating a sheet-like member by using a similar thermal fixing device, for example, in a laminator.

It is an objective of the present invention to enable proper temperature control of a thermal fixing apparatus that includes a plurality of heaters for heating a fixing member at different axial positions and to enable proper detection of problems in one of the heaters.

A thermal fixing device according to one aspect of the present invention is for thermally fixing one medium to another medium and includes a fixing member, a main heater, an end heater, a main portion temperature detector, an end portion temperature detector, and a heater controller.

The fixing member thermally fixes the medium to the other medium. The fixing member is elongated in an elongated direction and has a main portion and an end portion aligned side by side in the elongated direction. The main heater heats the main portion of the fixing member and end heater heats the end portion of the fixing member. The main portion temperature detector detects temperature at the main portion of the fixing member. The end portion temperature detector detects temperature at the end portion of the fixing member.

The heater controller controls drive of the main heater and the end heater based on temperatures detected by the main portion temperature detector and the end portion temperature detector.

A thermal fixing device according to another aspect of the present invention is for thermally fixing one medium to another medium and includes a fixing member, a main heater, an end heater, a main portion temperature detector, an end portion temperature detector, and a diagnosing unit.

The fixing member thermally fixes the medium to the other medium. The fixing member is elongated in an elongated direction and has a main portion and an end portion aligned side by side in the elongated direction. The main heater heats the main portion of the fixing member and end heater heats the end portion of the fixing member. The main portion temperature detector detects temperature at the main portion of the fixing member. The end portion temperature detector detects temperature at the end portion of the fixing member.

The diagnosing unit judges whether the main heater and the end heater are operating properly based on temperatures detected by the main portion temperature detector and the end portion temperature detector.

An image forming device according to one aspect of the present invention is for forming images on a medium and includes an image forming unit, a thermal fixing device, a main portion temperature detector, an end portion temperature detector, and a heater controller.

The image forming unit forms the images on the medium.

The thermal fixing device thermally fixes the images onto the medium. The thermal fixing device includes a fixing member, a main heater, and an end heater. The fixing member thermally fixes the images onto the medium. The fixing member is elongated in an elongated direction and has a main portion and an end portion aligned side by side in the elongated direction. The main heater heats the main portion of the fixing member and the end heater heats the end portion of the fixing member.

The main portion temperature detector detects temperature at the main portion of the fixing member and the end portion temperature detector detects temperature at the end portion of the fixing member.

The heater controller controls drive of the main heater and the end heater based on temperatures detected by the main portion temperature detector and the end portion temperature detector.

An image forming device according to another aspect of the present invention is for forming images on a medium and includes an image forming unit, a thermal fixing device, a main portion temperature detector, an end portion temperature detector, and a diagnosing unit.

The image forming unit forms the images on the medium.

The thermal fixing device thermally fixes the images onto the medium. The thermal fixing device includes a fixing member, a main heater, and an end heater. The fixing member thermally fixes the images onto the medium. The fixing member is elongated in an elongated direction and has a main portion and an end portion aligned side by side in the elongated direction. The main heater heats the main portion of the fixing member and the end heater heats the end portion of the fixing member.

The main portion temperature detector detects temperature at the main portion of the fixing member and the end portion temperature detector detects temperature at the end portion of the fixing member.

The diagnosing unit judges whether the main heater and the end heater are operating properly based on temperatures detected by the main portion temperature detector and the end portion temperature detector.

BRIEF DESCRIPTION OF THE DRAWINGS

In the accompanying drawings:

FIG. 5 is a graph representing change in a center temperature $T_A$ and an end temperature $T_B$ of the thermal roller after power is turned ON;

DETAILED DESCRIPTION OF THE PREFERRED EMBODIMENT

Figure 1:
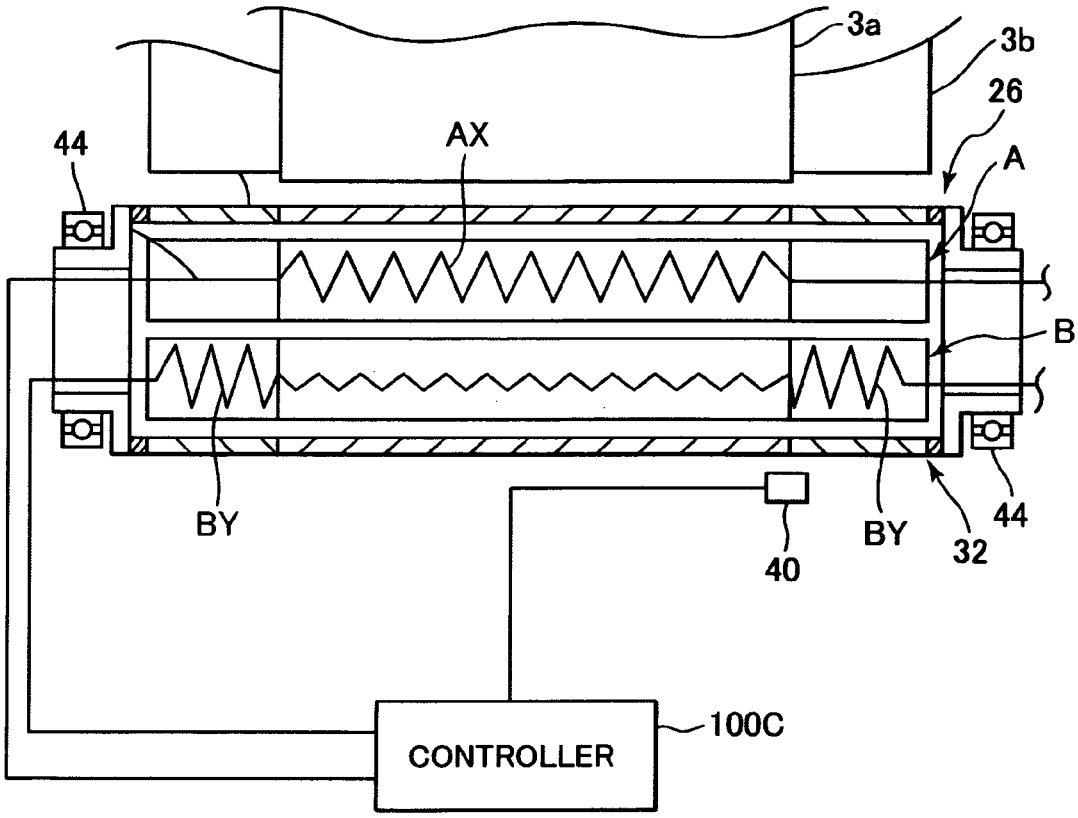
FIG. 1 is a sectional view showing a conceivable thermal roller used in a laser printer.
Figure 2:
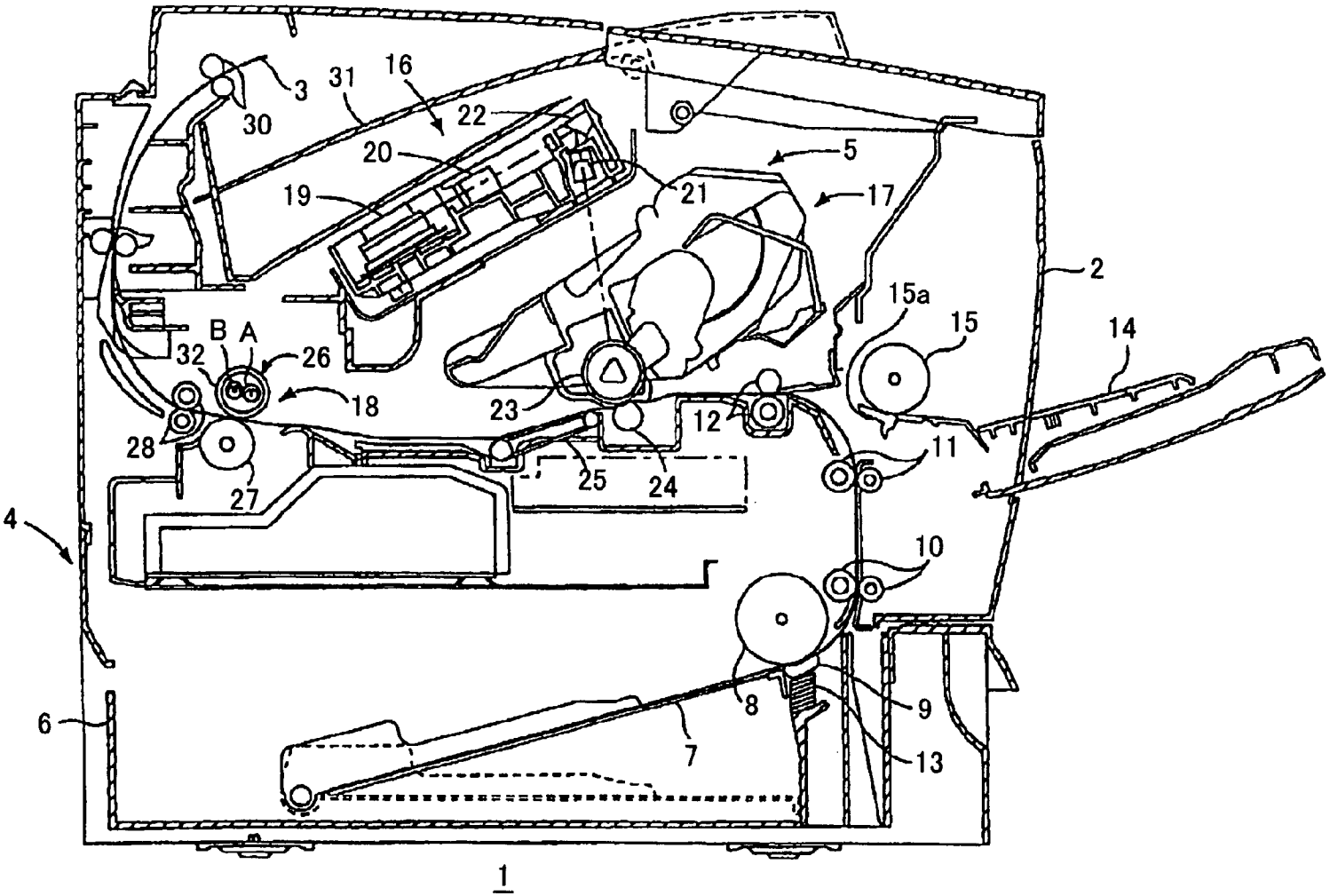
FIG. 2 is a sectional view showing a laser printer according to an embodiment of the present invention.

In the following, a laser printer 1 according to an embodiment of the present invention will be described. As shown in FIG. 2 the laser printer 1 includes a main body casing 2, a feeder portion 4, an image forming portion 5, and a thermal fixing device 18. The feeder portion 4, the image forming portion 5, and the thermal fixing device 18 are housed within the casing 2. The feeder portion 4 is for feeding sheets 3 to the image forming portion 5. The image forming portion 5 forms toner images on the sheets 3 from the feeder portion 4. The thermal fixing device 18 is for thermally fixing the toner images onto the sheets.

The feeder portion 4 is located at the bottom of the main body casing 2 and includes a detachable sheet feeding tray 6, a sheet pressing plate 7, a sheet feeding roller 8, a sheet feeding pad 9, transport rollers 10 and 11, and registration rollers 12. The sheet pressing plate 7 is provided in the sheet feeding tray 6. The sheet feeding roller 8 and the sheet feeding pad 9 are provided above one end portion of the sheet feeding tray 6. The transport rollers 10 and 11 are provided downstream from the sheet feeding roller 8 with respect to the transporting direction for the sheet 3. Hereinafter, upstream and downstream with respect to the transporting direction for the sheet 3 will be simply referred to as upstream and downstream. The registration rollers 12 are provided downstream from the transport rollers 10 and 11.

The sheet pressing plate 7 supports sheets 3 in a stack. The sheet pressing plate 7 is swingably supported at the end farther from the sheet feeding roller 8 to thereby make the end nearer to the sheet feeding roller 8 vertically movable. Further, the sheet pressing plate 7 is upwardly urged from the back side by a spring (not shown). Thus, as the number of sheets 3 stacked increases, the sheet pressing plate 7 is swung downwardly against the urging force of the spring, using the end farther from the sheet feeding roller 8 as the fulcrum. The sheet feeding roller 8 and the sheet feeding pad 9 are opposed to each other, and the sheet feeding pad 9 is pressed against the sheet feeding roller 8 by a spring 13 arranged on the back side of the sheet feeding pad 9. The uppermost sheet 3 on the sheet pressing plate 7 is pressed against the sheet feeding roller 8 from the back side of the sheet pressing plate 7 by a spring (not shown), and is caught between the sheet feeding roller 8 and the sheet feeding pad 9 through the rotation of the sheet feeding roller 8, the sheets being fed one by one. The fed sheet 3 is sent to the registration rollers 12 by the transport rollers 10 and 11. The registration rollers 12 are adapted to send the sheet 3 to the image forming position after effecting a predetermined registration operation. The image forming position is the transfer position where a toner image on a photosensitive drum 23 is transferred to the sheet 3 and, in this embodiment, is the position where the photosensitive drum 23 and a transfer roller 24 are in contact with each other.

The feeder portion 4 is further equipped with a multi-purpose tray 14, a multi-purpose sheet feeding roller 15 for feeding the sheets 3 stacked on the multi-purpose tray 14, and a multi-purpose sheet feeding pad 15*a*. The multi-purpose sheet feeding roller 15 and the multi-purpose sheet feeding pad 15*a* are opposed to each other, and the multi-purpose sheet feeding pad 15*a* is presses against the multi-purpose sheet feeding roller 15 by a spring (not shown) arranged on the back side of the multi-purpose sheet feeding pad 15*a*. The sheets 3 stacked on the multi-purpose tray 14 are fed one by one after being caught between the multi-purpose sheet feeding roller 15 and the multi-purpose sheet feeding pad 15*a* through rotation of the multi-purpose sheet feeding roller 15.

The image forming portion 5 includes a scanner unit 16, a process cartridge 17, and the transfer roller 24.

The scanner unit 16 is provided in the upper portion of the interior of the main body casing 2, and includes a laser emitting portion (not shown), a rotationally driven polygon mirror 19, lenses 20 and 21, and a reflection mirror 22. A laser beam based on image data emitted from the laser emitting portion is passed through or reflected by the polygon mirror 19, the lens 20, the reflection mirror 22, and the lens 21 in that order as indicated by the chain line in FIG. 2 and scanned at a high speed across the surface of the photosensitive drum 23 of the process cartridge 17 described below.

The process cartridge 17 is arranged below the scanner unit 16, and is detachable with respect to the main body casing 2. Although not shown, the process cartridge 17 further includes a scorotron charger, a developing roller, and a toner accommodating portion.

The toner accommodating portion is filled with a positively charged, non-magnetic single-component polymer toner as the developer, and the toner is borne on the developing roller in a thin layer of uniform thickness.

The photosensitive drum 23 is rotatably arranged opposite to the developing roller. The drum main body is grounded, and the surface thereof is formed by a positively charged photosensitive layer formed of polycarbonate and the like.

As the photosensitive drum 23 rotates, the surface of the photosensitive drum 23 is charged positively and uniformly by the scorotron charger, and then is exposed through high speed scanning with the laser beam from the scanner unit 16. The electric potential at the surface of the photosensitive drum 23 drops at positions exposed by the laser beam, thus forming an electrostatic latent image based on predetermined image data on the surface of the photosensitive drum 23. Thereafter, when the latent image is rotated into confrontation with the developing roller, the toner borne on the developing roller shifts to the electrostatic latent image on the surface of the photosensitive drum 23 to develop the electrostatic latent image into a visual toner image, thereby achieving reversal development.

The transfer roller 24 is rotatably supported below and in confrontation with the photosensitive drum 23. The transfer roller 24 is formed by coating a metal roller shaft with a conductive rubber material, and a predetermined transfer bias is applied thereto with respect to the photosensitive drum 23. The visible toner image borne on the photosensitive drum 23 is transferred to the sheet 3 while the sheet 3 passes between the photosensitive drum 23 and the transfer roller 24. The sheet 3 to which the visible image has been transferred is transported through a transport belt 25 to the thermal fixing device 18 described below.

This laser printer 1 is capable of performing printing on a small size sheet 3 (hereinafter referred to as the small size sheet 3*a*) and a large size sheet 3 (hereinafter referred to as the large size sheet 3*b*) , and the thermal fixing device 18 is accordingly designed so as to allow fixing on the small size sheet 3*a* and the large size sheet 3*b*. In the following, the specific structure and control for performing fixing on the small size sheet 3*a* and the large size sheet 3*b* by this thermal fixing device 18 will be described in detail. In the present embodiment, an A5 vertical sheet and an A6 horizontal sheet (having a width of 148 mm) are examples of the small size sheet 3*a* and an A4 vertical sheet (having a width of 209 mm) is an example of the large size sheet 3*b*.

The thermal fixing device 18 is arranged downstream from the process cartridge 17, and includes a thermal roller 26, a pressure roller 27, and transport rollers 28. The pressure roller 27 confronts and presses against the thermal roller 26, with the transport path for the sheet 3 interposed between the pressure roller 27 and the thermal roller 26. The transport rollers 28 are provided downstream from the thermal roller 26 and the pressure roller 27.

Figure 3:
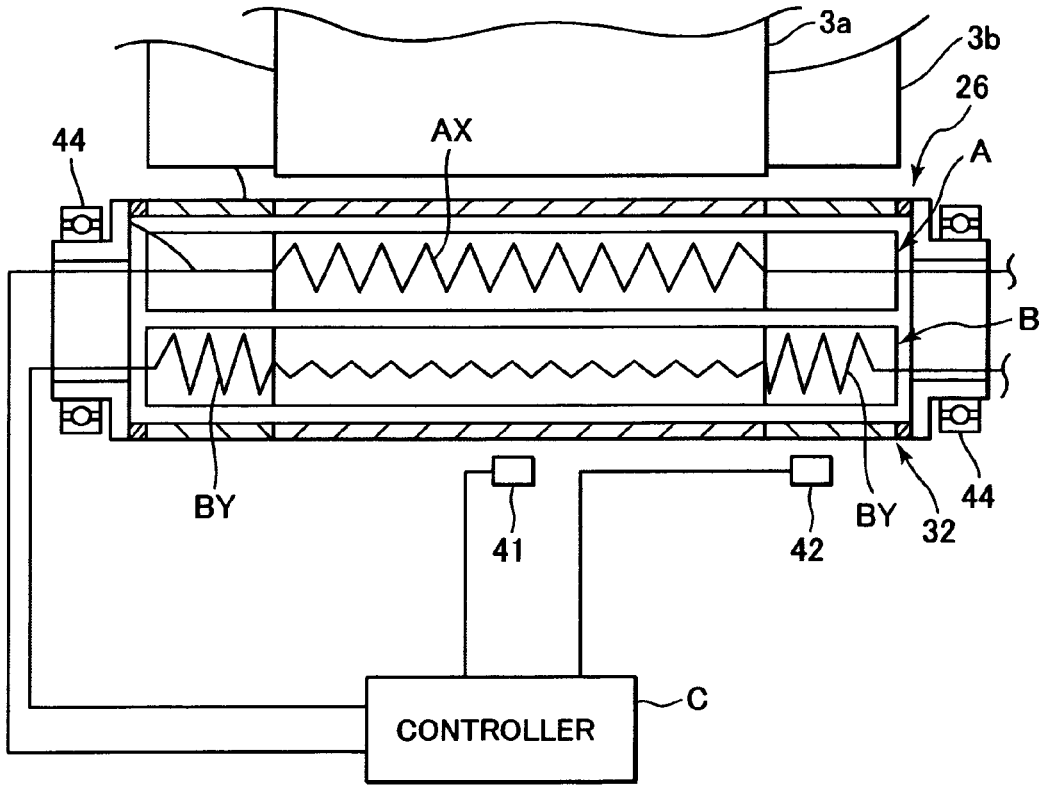
FIG. 3 is a sectional view showing a thermal roller used in the laser printer of the embodiment.

As shown in FIG. 3, the thermal roller 26 Includes a cylindrical aluminum roller main body 32, a center halogen lamp A, and an end halogen lamp B. The roller main body 32 is rotatably mounted on bearings 44 so as to rotate about an imaginary axis of rotation.

Figure 4:
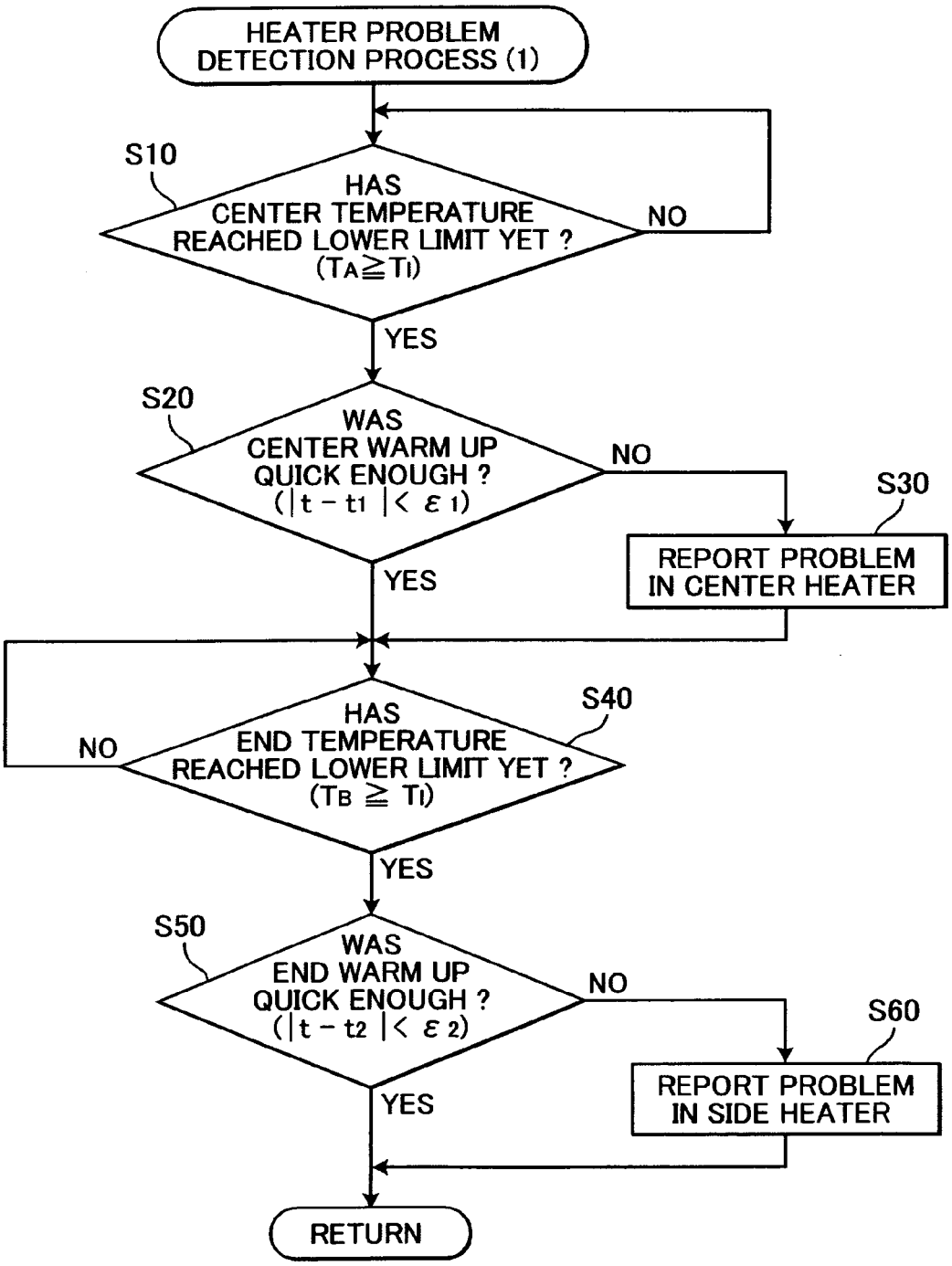
FIG. 4 is a flowchart representing a heater problem detection process (1) used in control of the thermal roller of FIG. 3.

As shown in FIG. 4, the center halogen lamp A and the end halogen lamp B both extend across the entire axial length of the roller main body 32 and are arranged in parallel with each other on opposites sides of the axis of rotation. The lamps A and B are stationary. As a result, the roller main body 32 rotates around the lamps A, B. The center halogen lamp A has a heating region AX that is near the center of the roller main body 32 with respect to the axial length of the roller main body 32 The heating region AX has a length, with respect to the axial length of the roller main body 32, that is substantially the same as the width of the small sized sheet 3*a*. Said differently, the light distribution of the center halogen lamp A generates the greatest heat at the heating region AX, thereby heating up the center region of the roller main body 32. The end halogen lamp B has heating regions BX that are near the ends of the roller main body 32 with respect to the axial length of the roller main body 32. Said differently, the heating regions BX are located to the outside of the heating region AX and within the range of the width of the large sized sheet 3*a*. The light distribution of the end halogen lamp B generates the greatest heat at the heating regions BX. It should be noted that the portion of each of the halogen lamps A, B that generates the greatest heat is alternately referred to as the heat peak portion of the lamp.

The heat generated by the center halogen lamp A and the end halogen lamp B heats the roller main body 32.

Referring back to FIG. 2, the pressure roller 27 is composed of a metal roller shaft and a roller of an resilient material covering the metal roller shaft. The pressure roller 27 presses against the thermal roller 26 with a predetermined force.

The thermal fixing device 18 thermally fixes the toner image transferred to the sheet 3 in the process cartridge 17 while the sheet 3 passes between the thermal roller 26 and the pressure roller 27.

The sheet 3 which has undergone fixing in the thermal fixing device 18 is then transported to the transport rollers 28 provided downstream from the thermal fixing device 18 and to transport rollers 29 and discharge rollers 30 provided downstream from the transport rollers 28 before being discharged onto a discharge tray 31 by the discharge rollers 30.

As shown in FIG. 3, the thermal fixing device 18 further includes a center temperature sensor 41 and a end temperature sensor 42. The center temperature sensor 41 is located at a position of the thermal roller 26 that corresponds to the heat peak portion of the center halogen lamp A and measures a center temperature near the center of the thermal roller 26. The end temperature sensor 42 is located at a position that corresponds to the heat peak portion of the end halogen lamp B and measures an end temperature near the end of the thermal roller 26. A controller C accurately detects the center and end temperatures, and turns ON and OFF the center halogen lamp A and the end halogen lamp B as appropriate to control the temperature of the roller main body 32.

Although not show, a power supply switch is provided for the user to turn ON to supply power to various components of the thermal fixing unit, such as to the lamps A, B.

Although not shown, the controller C also includes a ROM, a RAM, and a timer. The ROM is for storing various values that are predetermined and stored in advance, and also various programs. The timer measures elapse of time, for example, from when the power supply switch is turned ON. The RAM is for storing various values, such as the times measured by the timer.

Figure 5:
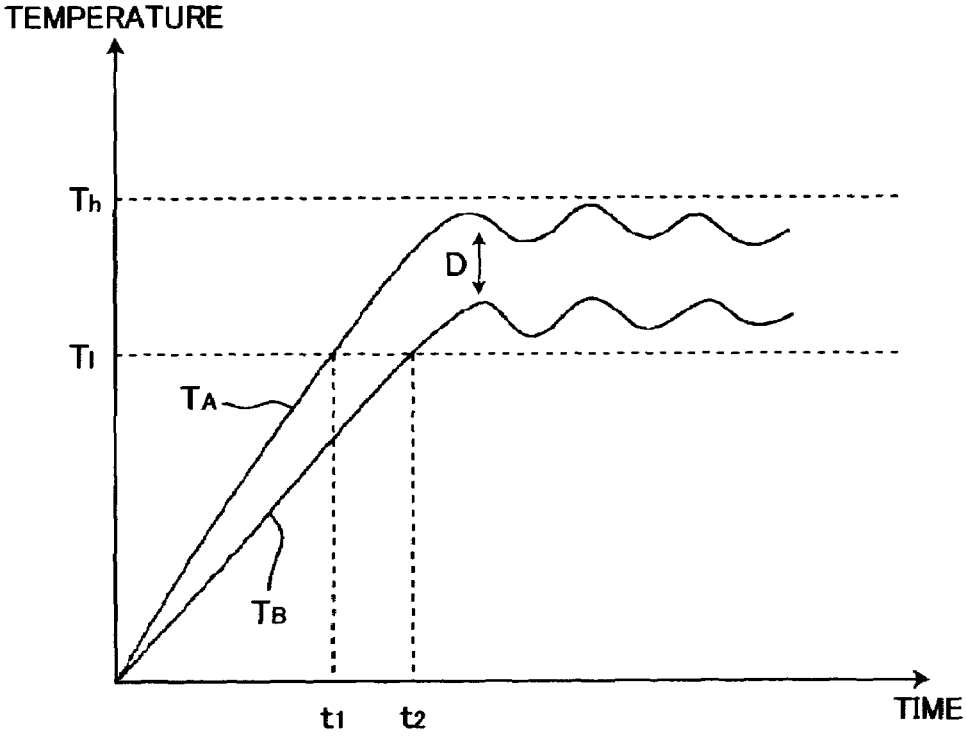

The controller C also detects problems generated in the halogen lamps A and B using a heater problem detection process (1) represented by the flowchart in FIG. 4. This process is started when a power supply switch (not shown) of the laser printer 1 is turned ON, so that power is supplied to drive the lamps A and B. When this process is started, a judgment is first made in step (hereinafter abbreviated to "S") 10 as to whether or not the center temperature $T_A$ of the thermal roller 26 detected by the center temperature sensor 41 is greater than or equal to a fixing lower limit temperature $T_l$. At a temperature lower than the fixing lower limit temperature $T_l$, the toner is not melted to a sufficient degree and remains as powder, so that it is fixed properly to the sheet 3. When the center temperature $T_A$ is lower than the fixing lower limit temperature $T_l$, the procedure returns to S10, until the fixing lower limit temperature $T_l$ is reached. When the center temperature $T_A$ is greater than or equal to the fixing lower limit temperature $T_l$ (S10: YES), the procedure advances to S20, where a judgment is made as to whether the absolute value of the difference between the time t that has elapsed since the power turning on and an average center warm-up time $t_1$ is less than an acceptable limit $\epsilon_1$ or not. As shown in the graph of FIG. 5, the average center warm-up time $t_1$ is the average time required from when power, that is, the center halogen lamp A, is turned ON to when the center halogen lamp A attains the fixing lower limit temperature $T_l$. The average center warm-up time $t_1$ is predetermined and stored in the memory (not shown) of the controller C. When the absolute value of the difference between the elapsed time t and the average center warm-up time $t_1$ is greater than or equal to the acceptable limit $\epsilon_1$, the procedure advances to S30, where the administrator is informed that the center halogen lamp A has a problem with it, and the procedure advances to S40. When the absolute value of the difference between the elapsed time t and the average center warm-up time $t_1$ is less than the acceptable limit $\epsilon_1$ (S20: YES), the procedure advances directly to S40.

In S40, a judgment is made as to whether or not the end temperature $T_B$ of the portion of the thermal roller 26 near the end is greater than or equal to the fixing lower limit temperature $T_l$. When the end temperature $T_B$ is lower than the fixing lower limit temperature $T_l$, the procedure returns to S40 until the fixing lower limit temperature $T_l$ is reached. When the end temperature $T_B$ is greater than or equal to the fixing lower limit temperature $T_l$ (S40: YES), the procedure advances to S50, where a judgment is made as to whether the absolute value of the difference between the elapsed time t and an average end warm-up time $t_2$ is less than an acceptable limit $\epsilon_2$ or not. As shown in the graph of FIG. 5, the average end warm-up time $t_2$ is the average time it takes for the end halogen lamp B to attain the fixing lower limit temperature $T_l$ after the power, that is, the end halogen lamp B, is turned ON. When the absolute value of the difference between the elapsed time t and the average end warm-up time $t_2$ is greater than or equal to the acceptable limit $\epsilon_2$, the procedure advances to S60, where the administrator is informed that the end halogen lamp B has a problem with it. Then this process is completed. When the absolute value of the difference between the elapsed time t and the average end warm-up time $t_2$ is less than the acceptable limit $\epsilon_2$ (S50: YES), this process is terminated.

With this process, it is possible to independently detect problems in the halogen lamps A and B at start-up of the laser printer 1. The administrator is informed about exactly which of the lamps has a problem, so the administrator does not need to make an in depth investigation to discover which lamp has the problem. Further, no time consuming diagnosis process is required in which the electricity supply to one lamp is stopped, and the portion that has been heated by that lamp is waited for to be cooled before checking the other lamp for problem, judging the first lamp as out of order if the other one has no problem.

The heat of the end portion of the thermal roller 26 is conducted by the bearing 44 that support the end portion of the thermal roller 26. Therefore, generally speaking, the end temperature of the thermal roller 26 rises more slowly than the center temperature. For this reason, the average end warm-up time $t_2$ is set to a duration that is longer than the average center warm-up time $t_1$. It should be noted that the times $t_1$ and $t_2$ need not be constantly fixed values, but instead changed according to the temperature of the thermal roller 26 when power is turned ON. The acceptable limits $\epsilon_1$ and $\epsilon_2$ could also be variable in a similar manner.

Figure 6:
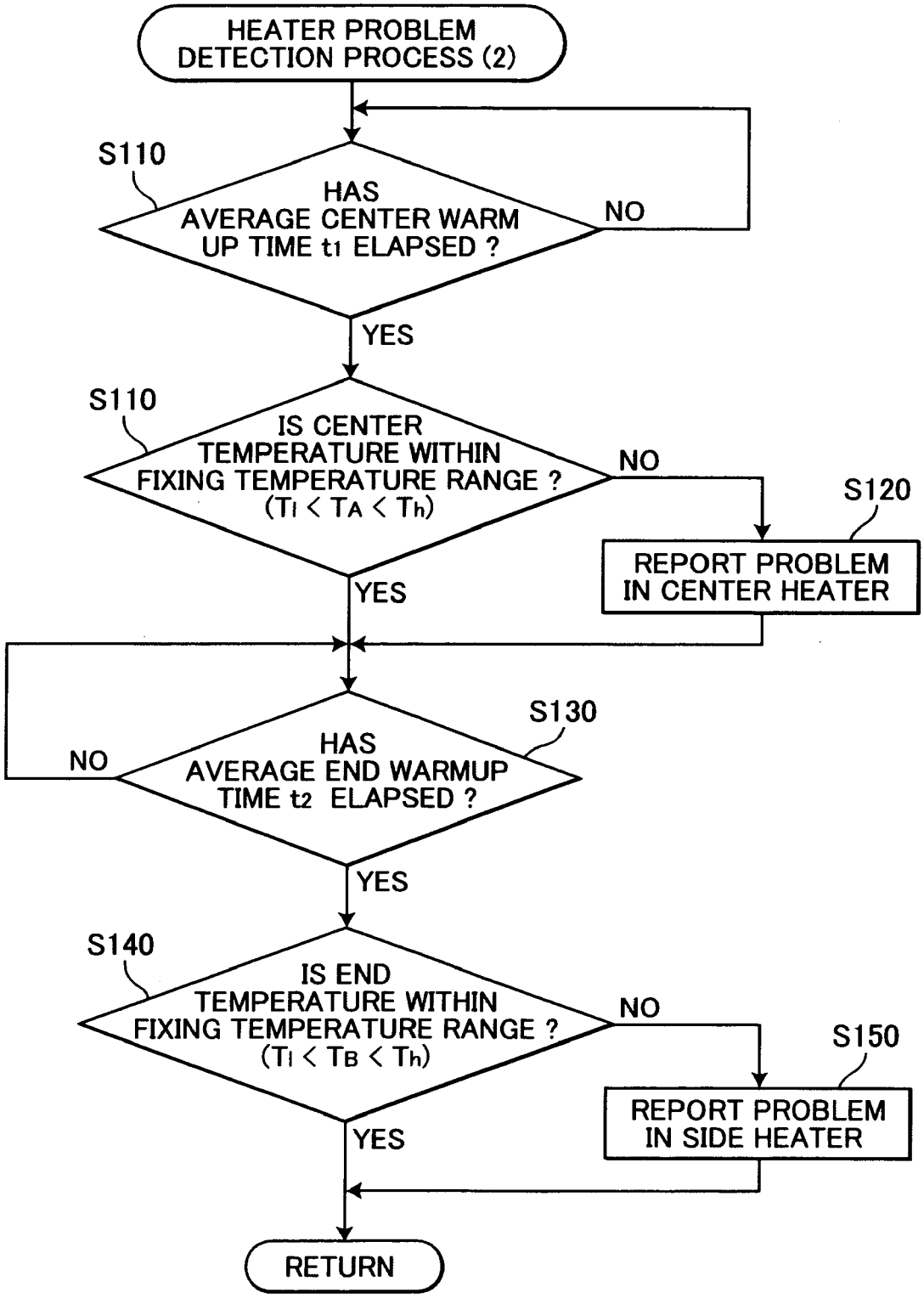
FIG. 6 is a flowchart representing a heater problem detection process (2) according to a first modification of the embodiment.

Next, a heater problem detection process (2) according to a first modification of the embodiment will be described with reference to FIG. 6. This process is also started when the power of the laser printer 1 is turned on. When this process is started, a judgment is first made in S100 as to whether or not the average center warm-up time $t_1$ has elapsed since the power supply switch was turned ON. When the average center warm-up time $t_1$ has not elapsed, the procedure returns to S100 until the average center warm-up time $t_1$ elapses. When the average center warm-up time $t_1$ has elapsed (S100: YES), a judgment is made as to whether the center temperature $T_A$ of the thermal roller 26 detected by the center temperature sensor 41 is higher than a fixing lower limit temperature $T_l$ and lower than a fixing upper limit temperature $T_h$. At a temperature higher than the fixing upper limit temperature $T_h$, hot offset is generated. When the center temperature $T_A$ of the thermal roller 26 is not in this range (hereinafter referred to as the fixing temperature range), the procedure advances to S120, where the administrator is informed that the center halogen lamp A has a problem with it, and then the procedure advances to S130. When the center temperature $T_A$ of the thermal roller 26 is in the fixing temperature range, the procedure advances directly to S130.

In S130, a judgment is made as to whether or not the average end warm-up time $t_2$ has elapsed since the turning on of the power. When the average end warm-up time $t_2$ has not elapsed, the procedure returns to S130 until the average end warm-up time $t_2$ elapses. When the average end warm-up time $t_2$ has elapsed (S130: YES), a judgment is made in S140 as to whether the end temperature $T_B$ detected by the end temperature sensor 42 is in the fixing temperature range or not. When the end temperature $T_B$ is not in the fixing temperature range, the procedure advances to S150, where the administrator is informed that the end halogen lamp B has a problem with it. Then, the process is completed. When the end temperature $T_B$ is in the fixing temperature range, this process is terminated With this process also, it is possible to independently detect problems in the halogen lamps A and B at start-up of the laser printer 1. Further, this process makes it possible to detect problems even if the lamps A, B are not capable of heating the thermal roller the fixing lower limit temperature $T_l$. It should be noted that the times $t_1$ and $t_2$ need not be constantly fixed values, but may be varied according to the temperature of the thermal roller 26 at the time that power is turned on.

Figure 7:
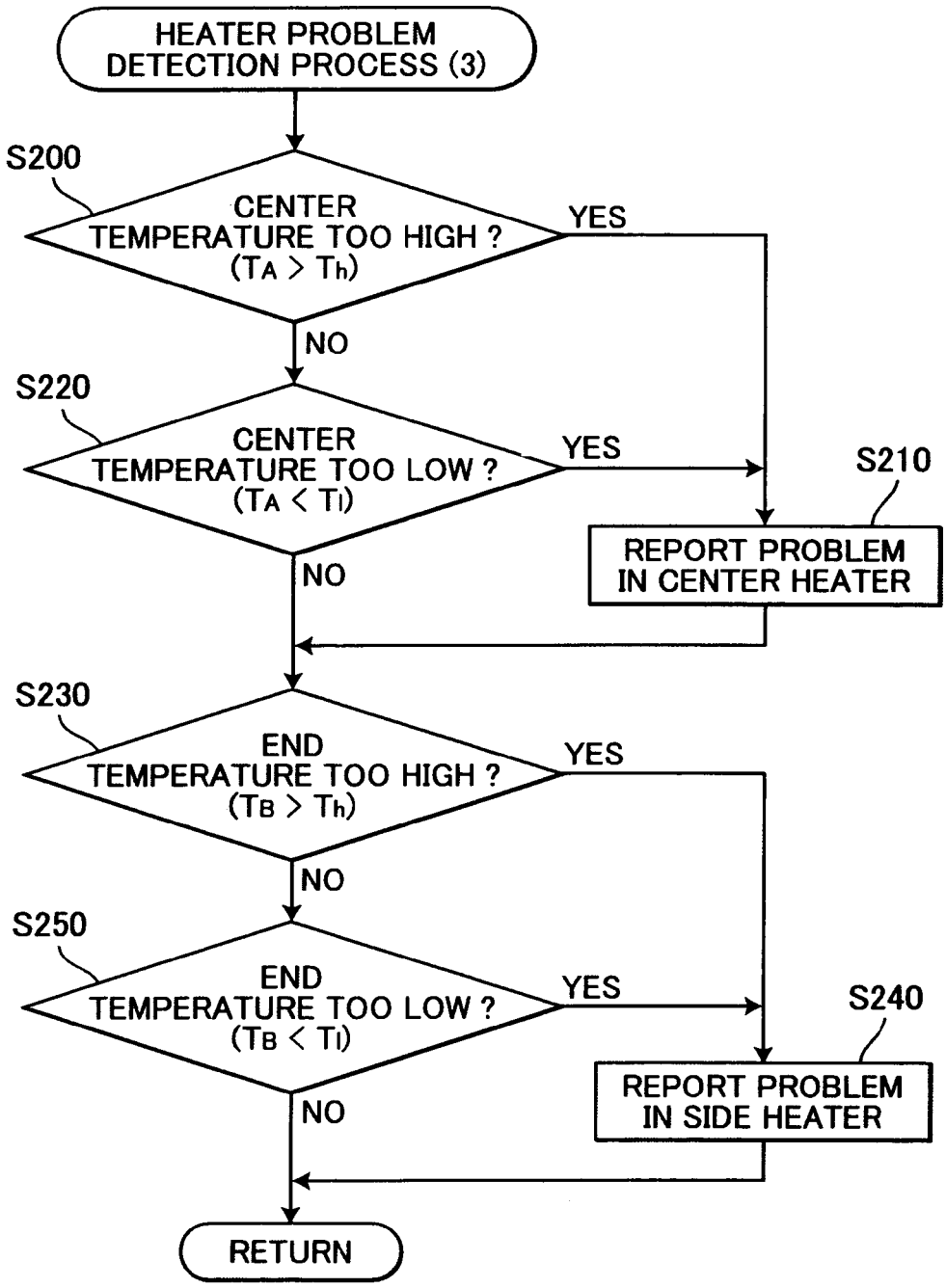
FIG. 7 is flowchart representing a heater problem detection process (3) according to a second modification of the embodiment.

Next, a heater problem detection process (3) according to a second modification of the embodiment will be described with reference to FIG. 7. This is an interrupt process that is executed once every time a fixed time elapses during printing (thermal fixing) in the laser printer 1. When this process is started, a judgment is first made in S200 as to whether the center temperature $T_A$ of the thermal roller 26 is higher than the fixing upper limit temperature $T_h$ or not. When it is higher, the procedure advances to S210, where the administrator is informed that the center halogen lamp A has a problem with it, and the procedure advances to S230. When the center temperature $T_A$ of the thermal roller 26 is not higher than the fixing upper limit temperature $T_h$ (S200: NO), the procedure advances to S220, where a judgment is made as to whether the center temperature $T_A$ of the thermal roller 26 is lower than the fixing lower limit temperature $T_l$ or not. When the center temperature $T_A$ of the thermal roller 26 is lower than the fixing lower limit temperature $T_l$, the procedure advances to S210; if not, the procedure advances to S230.

In S230, a judgment is made as to whether the end temperature $T_B$ is higher than the fixing upper limit temperature $T_h$ or not. When it is higher, the procedure advances to S240, where the administrator is informed that the end halogen lamp B has a problem with it, with which the process is completed. When the end temperature $T_B$ is not higher than the fixing upper limit temperature $T_h$ (S230: NO), the procedure advances to S250, where a judgment is made as to whether the end temperature $T_B$ is lower than the fixing lower limit temperature $T_l$ or not. When the end temperature $T_B$ is lower than the fixing lower limit temperature $T_l$, the procedure advances to S240; if not, the process is terminated.

With this process, if one of the center temperature $T_A$ of the thermal roller 26 and the end temperature $T_B$ has strayed from the proper fixing temperature range, the administrator is informed of the problem in a way which makes it possible for the administrator to determine which of the halogen lamps A and B has the problem, thus enabling the administrator to appropriately cope with the situation.

Figure 8:
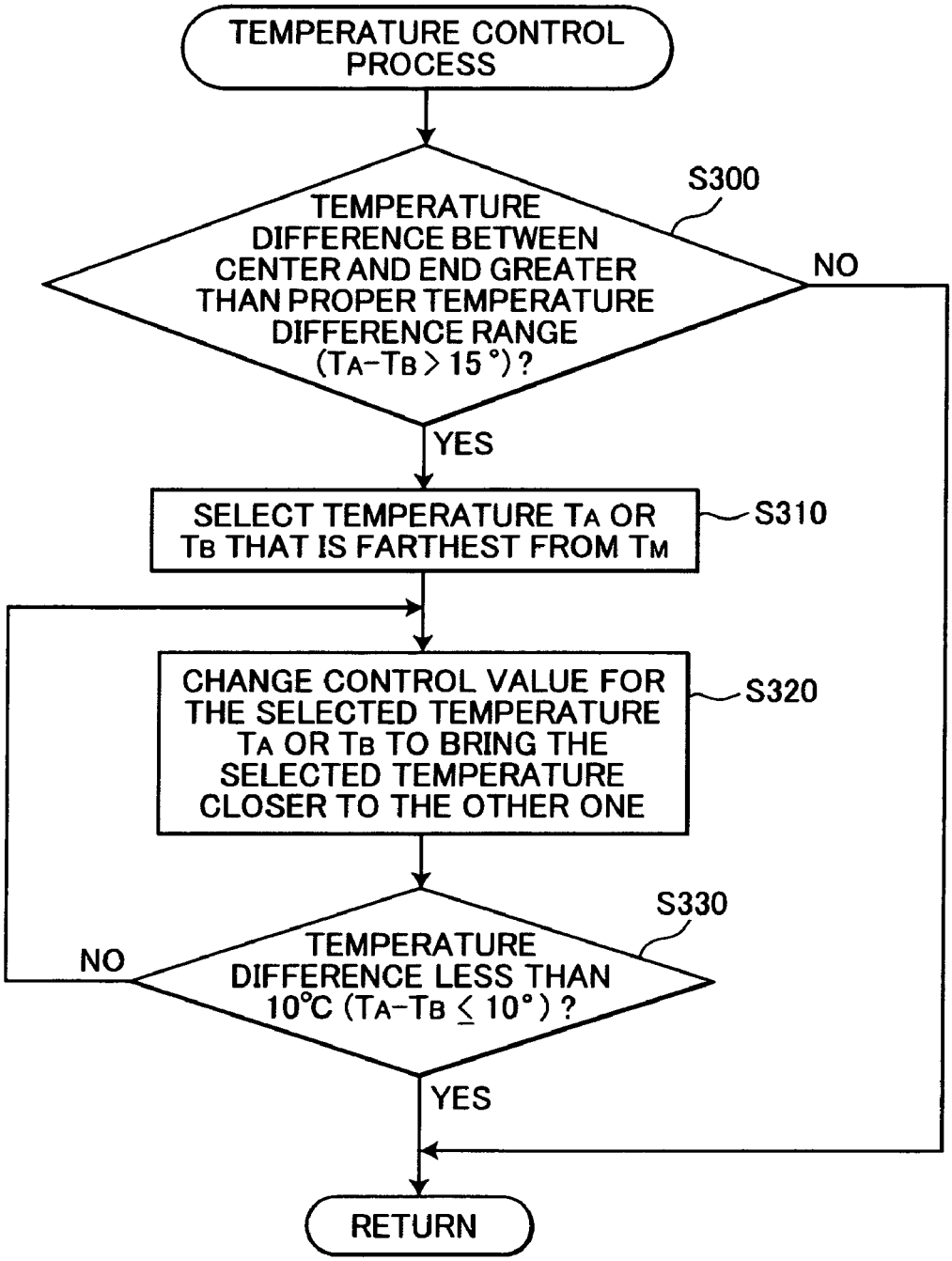
FIG. 8 is a flowchart representing a temperature control process according to a third modification of the embodiment.

Next, a temperature control process according to a third modification of the embodiment will be described with reference to FIG. 8. This is also an interrupt process that is executed each time a fixed time elapses during printing (thermal fixing) in the laser printer 1. When this process is started, a judgment is first made in S300 as to whether or not the difference between the center temperature $T_A$ and the end temperature $T_B$ exceeds a proper temperature difference range of 15° C. The proper temperature difference range of 15° C. is smaller than the thermal fixing range to insure that the both the center temperature $T_A$ and the end temperature $T_B$ are maintained within the thermal fixing range. When the detected temperature difference does not exceed the proper temperature difference range (S300: NO), the process is terminated; when it does (S300: YES), the procedure advances to S310. In S310, the center temperature $T_A$ or the end temperature $T_B$ that is farthest from a middle temperature $T_m$ is selected. The middle temperature $T_m$ is the average value of the fixing upper limit temperature $T_h$ and the fixing lower limit temperature $T_l$. In the example shown in the graph of FIG. 9, the center temperature $T_A$ of the thermal roller 26 is farther from the middle temperature $T_m$ than the end temperature $T_B$, so that the center temperature $T_A$ is selected.

Figure 9:
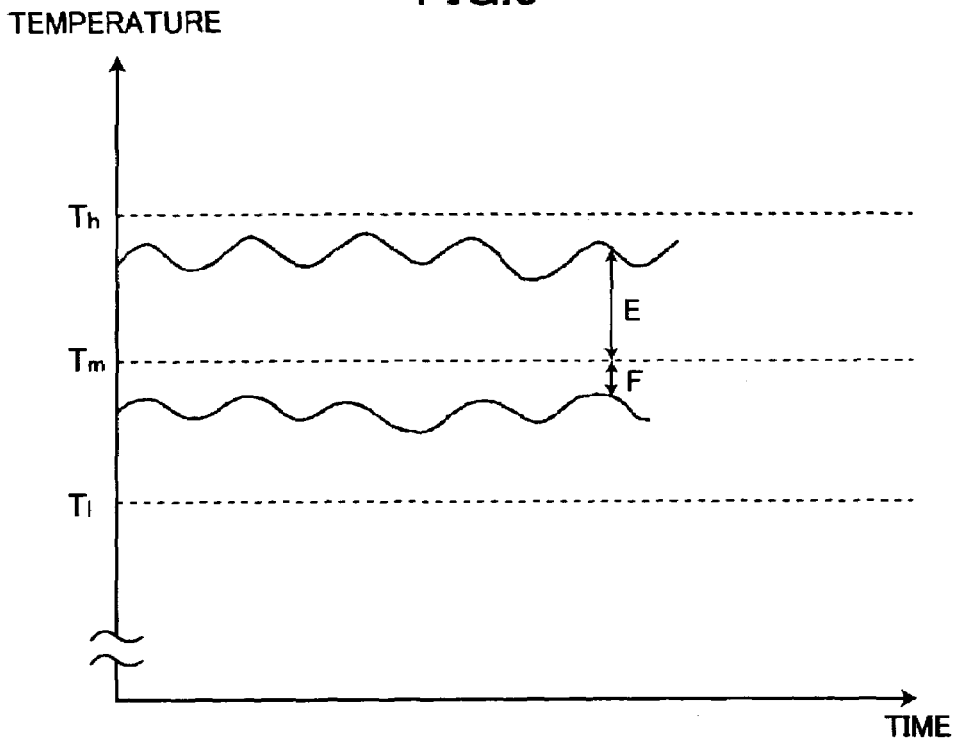
FIG. 9 is a graph representing change in the center temperature $T_A$ and the end temperature $T_B$ during printing.

Subsequently, in S320, the value used by the controller C to regulate the temperature of the farther halogen lamp, that is, the center halogen lamp A in the example of FIG. 9, is changed to adjust the selected temperature, that is, the center temperature $T_A$ in the example of FIG. 9, closer to the nearer temperature, that is, closer to the end temperature $T_B$ in the example of FIG. 9. And, in S330, a judgment is made as to whether the temperature difference has become 10° C. or less. When it has become 10° C. or less, the process is terminated; if not, the procedure returns to S320, where the control value is further changed.

With this process, the center and end temperatures $T_A$, $T_B$ can be regulated to nearer each other. If the temperature that was previously nearer to the middle temperature $T_m$ becomes farther from the middle temperature $T_m$, then as this process is repeated, it too will be regulated and moved to nearer the other temperature (which was previously the farther temperature). Therefore, the temperature either near the center or near the ends of the sheet being fixed can be regulated to a temperature somewhere between the fixing upper limit temperature $T_h$ and the fixing lower limit temperature $T_l$. It is possible to maintain a substantially uniform temperature over the entire axial length of the thermal roller 26, regardless of the size of the sheet being fixed with an image.

Figure 10:
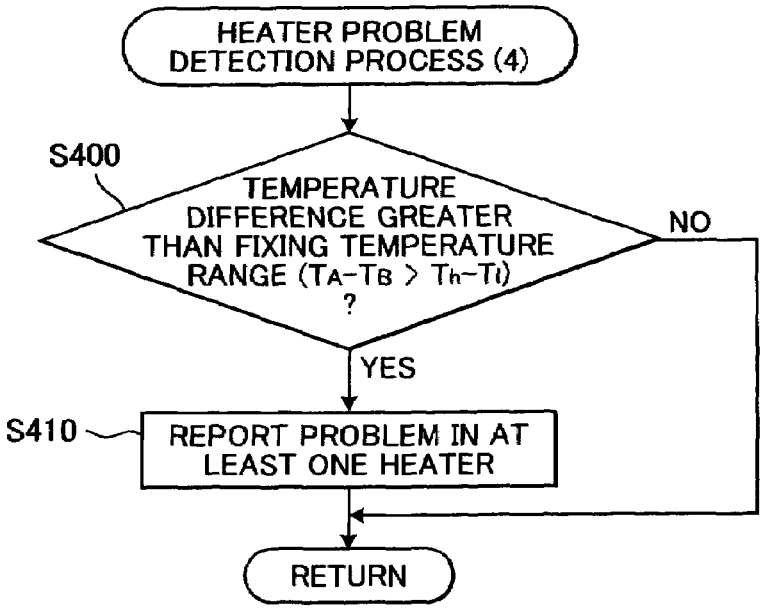
FIG. 10 is a flowchart representing a heater problem detection process (4) according to a fourth modification of the embodiment.

Next, a heater problem detection process (4) according to a fourth modification of the embodiment will be described with reference to FIG. 10. The heater problem detection process (4) detects problems with the center and end halogen lamps A and B using a control similar to the temperature control process according to the third modification. This is an interrupt process that is executed every time a fixed time elapses during printing (thermal fixing) in the laser printer 1.

When this process is started, a judgment is first made in S400 as to whether the temperature difference ($T_A$–$T_A$) between the center temperature $T_A$ of the thermal roller 26 and the end temperature $T_B$ exceeds the fixing temperature range ($T_h$–$T_l$) or not. When the temperature difference does not exceed the fixing temperature range, this process is terminated; when it does (S400: YES), the procedure advances to S410, where the administrator is informed that at least one lamp, that is, at least either the center halogen lamp A or the end halogen lamp B, has a problem. Then, the process is completed.

If the detected temperature difference exceeds the fixing temperature range, it means that at least one of the center temperature $T_A$ and the end temperature $T_B$ exceeds the upper limit value or falls short of the lower limit value. with this process, it is possible to properly determine that problem has been generated in at least one of the lamps. Due to the above-mentioned characteristics, if only one of the temperatures exceeds the upper limit value, it is usually the temperature of the portion heated by the center halogen lamp A, and if only one of the temperatures falls short of the lower limit value, it is usually the temperature of the portion heated by the end halogen lamp B.

The above description of the thermal fixing device 18 and the laser printer 1 to which the present invention is applied should not be construed restrictively, and various modifications are possible. For example, the present invention may be applied not to the thermal fixing device of the laser printer 1 but to that of a laminator.

Further, the specific values of 15° C. and 10° C. in the above-mentioned process (3) are only given by way of example. The values are subject to variation according to the characteristics of the toner and the construction of the thermal fixing device 18; the temperatures should be set to appropriate values according to the toner characteristics and the device construction. Further, although the embodiment describes reporting a problem during the heater problem detection process (3) when the center temperature $T_A$ of the thermal roller 26 or the end temperature $T_B$ exceeds the fixing upper limit temperature $T_h$ or falls short of the fixing lower limit temperature $T_l$, a problem can be reported when the center or end temperatures $T_A$, $T_B$ merely approaches the threshold values $T_A$, $T_B$. In this case, the threshold values $T_A$, $T_B$ can be judged to have been approached if the difference between the temperatures and the threshold values $T_A$, $T_B$ is 50% or less of the proper temperature range. However, it is preferable to judge that the threshold values $T_A$, $T_B$ have been approached if the difference is 20 to 30% of the proper temperature range. Further, while in the problem detection process (4) the temperature difference of the center temperature $T_A$ of the thermal roller 26 and the end temperature $T_B$ is compared with the fixing temperature range, it is also possible to compare the temperature difference with some other value, e.g., the proper temperature difference range used in the heater problem detection process (3).

Although the embodiment describes using different values for the times $t_1$ and $t_2$, the same value may be used for both. Further, a different range can be used as the proper temperature difference range for the center of the thermal roller than for the end portion of the thermal roller. Further, the times $t_1$ and $t_2$ may be used to indicate times required to reach a predetermined temperature before the fixing lower limit temperature $T_l$ is attained.

Although the embodiment describes the sensors 41, 42 as being located at positions of the thermal roller 26 that correspond to the heat peak portions of the halogen lamps A, B, the sensors 41, 42 could be located shifted away from the heat peak portions to a certain extent.

Also, the embodiment describes that the end halogen lamp B heats both axial ends of the roller main body 32. However, this is not to be considered a limitation of the present invention. For example, the halogen lamp A can be shifted to one axial end of the roller main body 32 to heat a main portion of the roller main body 32 and the end halogen lamp B can be designed to heat only the end portion of the roller main body 32 that is not heated by the halogen lamp A. A thermal fixing device with this configuration is capable of fixing toner onto different sized sheets as well. Also, other heaters beside halogen lamps can be used.

What is claimed is:

1. A thermal fixing device, comprising:

a fixing member that thermally fixes the medium to an other medium, the fixing member being elongated in an elongated direction and having a main portion and an end portion aligned side by side in the elongated direction;

a main heater that heats the main portion of the fixing member;

an end heater that heats the end portion of the fixing member;

a main portion temperature detector that detects a first temperature at the main portion of the fixing member, an end portion temperature detector that detects a second temperature at the end portion of the fixing member, a diagnosing unit that judges whether the main heater and the end heater are operating properly based on the first temperature and the second temperature;

a power supply starting unit that starts supply of power to the main heater and to the end heater;

a main warm up timer that measures a main warm up time from when the power supply starting unit starts supplying power to when the first temperature reaches a predetermined main warm up temperature, the diagnosing unit further judging whether the main warm up time measured by the main warm up timer exceeds a predetermined acceptable time limit and determining that the main heater is not operating properly when judged that the main warm up time measured by the warm up timer exceeds the acceptable main time limit; and an end warm up timer that measures an end warm up time from when the power supply starting unit starts supplying power to when the second temperature reaches a predetermined end warm up temperature, the diagnosing unit further judging whether the end warm up time measured by the end warm up timer exceeds a predetermined acceptable time limit and determining that the end heater is not operating properly when judged that the end warm up time measured by the warm up timer exceeds the acceptable end time limit, wherein the acceptable main time limit is the same as the acceptable end time limit.

2. The thermal fixing device as claimed in claim 1, wherein the main heater includes a main halogen lamp with a light distribution having a peak and the end heater includes an end halogen lamp with a light distribution having a peak, the first temperature being detected at a position corresponding to the peak of the main halogen lamp and the second temperature being detected at a position corresponding to the peak of the end halogen lamp.

3. The thermal fixing device as claimed in claim 1, wherein the fixing member is a heat roller.

4. A thermal fixing device, comprising:

a fixing member that thermally fixes the medium to an other medium, the fixing member being elongated in an elongated direction and having a main portion and an end portion aligned side by side in the elongated direction;

a main heater that heats the main portion of the fixing member;

an end heater that heats the end portion of the fixing member;

a main portion temperature detector that detects a first temperature at the main portion of the fixing member;

an end portion temperature detector that detects a second temperature at the end portion of the fixing member;

a diagnosing unit that judges whether the main heater and the end heater are operating properly based on the first temperature and the second temperature;

a power supply starting unit that starts supply of power to the main heater and to the end heater;

a main warm up timer that measures a main warm up time from when the power supply starting unit starts supplying power to when the first temperature reaches a predetermined main warm up temperature, the diagnosing unit further judging whether the main warm up time measured by the main warm up timer exceeds a predetermined acceptable time limit and determining that the main heater is not operating properly when judged that the main warm up time measured by the warm up timer exceeds the acceptable main time limit; and an end warm up timer that measures an end warm up time from when the power supply starting unit starts supplying power to when the second temperature reaches a predetermined end warm up temperature, the diagnosing unit further judging whether the end warm up time measured by the end warm up timer exceeds a predetermined acceptable time limit and determining that the end heater is not operating properly when judged that the end warm up time measured by the warm up timer exceeds the acceptable end time limit, wherein the acceptable main time limit is different from the acceptable end time limit.

5. The thermal fixing device as claimed in claim 4, wherein the main heater includes a main halogen lamp with a light distribution having a peak and the end heater includes an end halogen lamp with a light distribution having a peak, and the first temperature being detected at a position corresponding to the peak of the main halogen lamp and the second temperature being detected at a position corresponding to the peak of the end halogen lamp.

6. The thermal fixing device as claimed in claim 4, wherein the fixing member is a heat roller.

7. A thermal fixing device, comprising:

a fixing member that thermally fixes the medium to an other medium, the fixing member being elongated in an elongated direction and having a main portion and an end portion aligned side by side in the elongated direction;

a main heater that heats the main portion of the fixing member;

an end heater that heats the end portion of the fixing member;

a main portion temperature detector that detects a first temperature at the main portion of the fixing member;

an end portion temperature detector that detects a second temperature at the end portion of the fixing member;

a diagnosing unit that judges whether the main heater and the end heater are operating properly based on the first temperature and the second temperature;

a power supply starting unit that starts supply of power to the main heater and to the end heater;

a standard main warm up timer that judges whether a predetermined standard main warm up time has elapsed, the diagnosing unit further judging whether the first temperature is within a predetermined proper temperature range and determining that the main heater is not operating properly when judged that the first temperature is not within the predetermined proper temperature range when the standard main warm up timer judges that the standard main warm up time has elapsed; and a standard end warm up timer that judges whether a predetermined standard end warm up time has elapsed, the diagnosing unit further judging whether the second temperature is within a predetermined proper temperature range and determining that the end heater is not operating properly when judged that the second temperature is not within the predetermined proper temperature range when the standard end warm up timer judges that the standard end warm up time has elapsed, wherein the standard main warm up time and the standard end warm up time are the same.

8. The thermal fixing device as claimed in claim 7, wherein the main heater includes a main halogen lamp with a light distribution having a peak and the end heater includes an end halogen lamp with a light distribution having a peak, the first temperature being detected at a position corresponding to the peak of the main halogen lamp and the second temperature being detected at a position corresponding to the peak of the end halogen lamp.

9. The thermal fixing device as claimed in claim 7, wherein the fixing member is a heat roller.

10. A thermal fixing device, comprising:

a fixing member that thermally fixes the medium to an other medium, the fixing member being elongated in an elongated direction and having a main portion and an end portion aligned side by side in the elongated direction;

a main heater that heats the main portion of the fixing member;

an end heater that heats the end portion of the fixing member;

a main portion temperature detector that detects a first temperature at the main portion of the fixing member;

an end portion temperature detector that detects a second temperature at the end portion of the fixing member;

a diagnosing unit that judges whether the main heater and the end heater are operating properly based on the first temperature and the second temperature;

a power supply starting unit that starts supply of power to the main heater and to the end heater;

a standard main warm up timer that judges whether a predetermined standard main warm up time has elapsed, the diagnosing unit further judging whether the first temperature is within a predetermined proper temperature range and determining that the main heater is not operating properly when judged that the first temperature is not within the predetermined proper temperature range when the standard main warm up timer judges that the standard main warm up time has elapsed; and a standard end warm up timer that judges whether a predetermined standard end warm up time has elapsed, the diagnosing unit further judging whether the second temperature is within a predetermined proper temperature range and determining that the end heater is not operating properly when judged that the second temperature is not within the predetermined proper temperature range when the standard end warm up timer judges that the standard end warm up time has elapsed, wherein the standard main warm up time and the standard end warm up time are different.

11. The thermal fixing device as claimed in claim 10, wherein the main heater includes a main halogen lamp with a light distribution having a peak and the end heater includes an end halogen lamp with a light distribution having a peak, the first temperature being detected at a position corresponding to the peak of the main halogen lamp and the second temperature being detected at a position corresponding to the peak of the end halogen lamp.

12. The thermal fixing device as claimed in claim 10, wherein the fixing member is a heat roller.

13. A thermal fixing device comprising:

a fixing member that thermally fixes the medium to an other medium, the fixing member being elongated in an elongated direction and having a main portion and an end portion aligned side by side in the elongated direction;

a main heater that heats the main portion of the fixing member;

an end heater that heats the end portion of the fixing member;

a main portion temperature detector that detects a first temperature at the main portion of the fixing member;

an end portion temperature detector that detects a second temperature at the end portion of the fixing member;

a diagnosing unit that judges whether the main heater and the end heater are operating properly based on the first temperature and the second temperature;

a heater controller that controls drive of the main heater and the end heater such that each of the first temperature and the second temperature is between a lower temperature limit and an upper temperature limit higher than the lower temperature limit, wherein the diagnosing unit determines that the main heater is not operating properly when the first temperature is at least one of greater than the upper temperature limit and less than the lower temperature limit, and the diagnosing unit further determines that the end heater is not operating properly when the second temperature is at least one of greater than the upper temperature limit and less than the lower temperature limit.

14. The thermal fixing device as claimed in claim 13, wherein the main heater includes a main halogen lamp with a light distribution having a peak and the end heater includes an end halogen lamp with a light distribution having a peak, the first temperature being detected at a position corresponding to the peak of the main halogen lamp and the second temperature being detected at a position corresponding to the peak of the end halogen lamp.

15. The thermal fixing device as claimed in claim 13, wherein the fixing member is a heat roller.

16. A thermal fixing device comprising:

a fixing member that thermally fixes the medium to an other medium, the fixing member being elongated in an elongated direction and having a main portion and an end portion aligned side by side in the elongated direction;

a main heater that heats the main portion of the fixing member;

an end heater that heats the end portion of the fixing member, a main portion temperature detector that detects a first temperature at the main portion of the fixing member;

an end portion temperature detector that detects a second temperature at the end portion of the fixing member;

a diagnosing unit that judges whether the main heater and the end heater are operating properly based on the first temperature and the second temperature;

a heater controller that controls drive of the main heater and the end heater such that each of the first temperature and the second temperature is between a lower temperature limit and an upper temperature limit higher than the lower temperature limit by a predetermined upper-lower limit temperature difference; and a difference detector that detects an actual temperature difference between the first temperature and the second temperature, wherein the diagnosing unit judges whether the actual temperature difference is greater than the upper-lower limit temperature difference, and the diagnosing unit determines that at least one of the main heater and the end heater is not operating properly when judged that the actual temperature difference is greater than the upper-lower limit temperature difference.

17. The thermal fixing device as claimed in claim 16, wherein the main heater includes a main halogen lamp with a light distribution having a peak and the end heater includes an end halogen lamp with a light distribution having a peak, the first temperature being detected at a position corresponding to the peak of the main halogen lamp and the second temperature being detected at a position corresponding to the peak of the end halogen lamp.

18. The thermal fixing device as claimed in claim 16, wherein the fixing member is a heat roller.

* * * * *